US006815154B2

(12) United States Patent
Pirotto et al.

(10) Patent No.: US 6,815,154 B2
(45) Date of Patent: Nov. 9, 2004

(54) SILVER BROMOIODIDE CORE-SHELL GRAIN EMULSION

(75) Inventors: Davide Pirotto, Carcare (IT); Massimiliano Scioscia, Carcare (IT); Dario Stefanini, Savona (IT); Luisa Tavella, Savona (IT)

(73) Assignee: Ferrania, S.p.A., Savona (IT)

( * ) Notice: Subject to any disclaimer, the term of this patent is extended or adjusted under 35 U.S.C. 154(b) by 0 days.

(21) Appl. No.: 10/627,164

(22) Filed: Jul. 25, 2003

(65) Prior Publication Data

US 2004/0152025 A1 Aug. 5, 2004

(30) Foreign Application Priority Data

Jul. 29, 2002 (IT) ..... SV2002A0034

(51) Int. Cl.[7] ..... G03C 1/035; G03C 7/26
(52) U.S. Cl. ..... 430/506; 430/567; 430/569
(58) Field of Search ..... 430/567, 569, 430/506

(56) References Cited

U.S. PATENT DOCUMENTS

| | | | | |
|---|---|---|---|---|
| 4,312,941 A | | 1/1982 | Scharf et al. | 430/510 |
| 4,391,884 A | | 7/1983 | Meyer et al. | 430/17 |
| 4,439,520 A | | 3/1984 | Kofron et al. | 430/434 |
| 4,477,564 A | | 10/1984 | Cellone et al. | 430/567 |
| 4,521,507 A | | 6/1985 | Iijima et al. | 430/503 |
| 4,614,711 A | | 9/1986 | Sugimoto et al. | 430/567 |
| 4,668,614 A | | 5/1987 | Takada et al. | 430/567 |
| 4,692,400 A | * | 9/1987 | Kumashiro | |
| 4,728,602 A | | 3/1988 | Shibahara et al. | 430/567 |
| 4,740,454 A | | 4/1988 | Deguchi et al. | 430/567 |
| 5,275,929 A | | 1/1994 | Buitano et al. | 430/567 |
| 5,780,216 A | | 7/1998 | Ihama | 430/567 |
| 6,258,522 B1 | | 7/2001 | Mariotti et al. | 430/567 |

FOREIGN PATENT DOCUMENTS

| | | | |
|---|---|---|---|
| EP | 0 309 119 A2 | 3/1989 | G03C/1/02 |
| EP | 0 202 784 B1 | 9/1991 | G03C/1/005 |
| EP | 0 299 719 B1 | 1/1993 | G03C/1/005 |
| EP | 1 055 967 A1 | 11/2000 | G03C/7/30 |
| EP | 1 103 950 A2 | 5/2001 | G10K/11/34 |
| EP | 1 262 825 A1 | 12/2002 | G03C/1/76 |

* cited by examiner

*Primary Examiner*—Richard L. Schilling
(74) *Attorney, Agent, or Firm*—Mark A. Litman & Associates, P.A.

(57) ABSTRACT

The present invention relates to a light-sensitive emulsion, and a light-sensitive photographic material containing the same, comprising silver bromoiodide grains of a core shell structure comprising: a) an inner core consisting essentially of silver bromide or silver bromoiodide and having a silver iodide content within the range of 0 to 10 mole %, and b) a plurality of shells consisting essentially of silver bromide or silver bromoiodide, wherein said silver bromoiodide grains exhibit an average grain size lower than 0.60 micrometer, an average grain thickness lower than 0.15 micrometer, and an average aspect ratio lower than 5:1.

10 Claims, No Drawings

SILVER BROMOIODIDE CORE-SHELL GRAIN EMULSION

FIELD OF THE INVENTION

The present invention relates to photographic silver halide coreshell emulsions. More particularly, the invention relates to a silver bromoiodide emulsion having grains comprising several phases with different iodide content, which emulsion shows better sharpness and sensitometric properties.

BACKGROUND OF THE ART

In recent years, there have been more strict requirements for silver halide emulsions for photographic use. This has increased the demands for the high level photographic characteristics such as, for example, high speed, excellent graininess, low fog, wider exposure latitude range and so on.

The above mentioned requirements have been satisfied by well-known silver bromoiodide grain emulsions having grains with a specific core-shell structure (in which an inner core is covered by one or more shell having different silver halide composition) and a high silver iodide content in the inner part thereof. It is well known in the photographic art that light absorbing increases in the order of silver chloride, silver bromide and silver iodide, but development activity correspondingly decreases in the same order. By using the above described core-shell silver bromoiodide emulsions, a good balance between light sensitivity and development activity has been obtained.

Examples of core-shell silver bromoiodide emulsion are described in many patent and literature references. For example, U.S. Pat. Nos. 4,668,614 and 4,728,602 describe a monodispersed coreshell silver bromoiodide emulsion having a core part comprising a silver iodide content of 10 to 45 mol % and a shell part comprising a silver iodide content lower than 5 mol %., with an average silver iodide content higher than 7 mol %. When this emulsion was examined by X-ray diffractometry, two peaks were evidentiated, the first one corresponding to the high iodide core part, the second one to the low iodide shell part. According to the claimed invention, the ratio between the diffraction intensity of the two peaks is preferably in the range of from 1/10 to 3/1, more preferably 1/3 to 3/1.

Similarly, European application EP 299,719 discloses a core-shell silver halide emulsion having a core comprising not less than 10 mol % of silver iodide, at least one shell consisting of silver bromide or silver bromoiodide, the outermost of which has a silver iodide content not higher than 5 mol %, and an average silver iodide content of not less than 10 mol %.

EP 309,119 discloses a core-shell silver halide emulsion having at least three silver bromide or silver bromoiodide phases of different composition. According to a preferred embodiment, the innermost phase has a silver iodide content of at least 10 mol %, the outermost phase has a silver iodide content of not more than 6 mol %, and the intermediate phase has a silver iodide content difference with the outermost or innermost phase of at least 3 mol %. When examined by X-ray diffraction, the claimed emulsion shows three or more diffraction peaks, each corresponding to a phase containing a different percentage of iodide.

EP 202,784 describes a core-shell silver halide emulsion having an inner core essentially consisting of silver bromide or silver bromoiodide and a plurality of shells. The outermost shell has a silver iodide content ranging from 0 to 10 mol %, the innermost shell has a silver iodide content at last 6 mol % higher than that of the outermost shell, and an intermediate shell has a silver iodide content is at least 3 mol % lower than that of the innermost shell and at least 3 mol % higher than that of the outermost shell.

U.S. Pat. No. 4,477,564 describes a multiphase silver bromoiodide emulsion having an average silver iodide content higher than 12%.

U.S. Pat. No. 4,614,711 describes silver bromoiodide grains with a core shell structure with a core of silver bromide or bromiodide and a first layer composed of silver bromoiodide, exterior to said core and containing more iodide than said core by 10 mol % or more.

U.S. Pat. No. 5,780,216 discloses a color negative silver halide photographic material with a core shell emulsion having a plurality of shells comprising an inner core consisting essentialy of silver bromide or bromoiodide and a plurality of shells of silver bromide or silver bromoiodide comprising a high iodide shell interposed between two shells consisting essentially of silver bromide.

U.S. Pat. No. 6,258,522 discloses a light-sensitive emulsion comprising silver bromoiodide grains of a core shell structure comprising: a) an inner core consisting essentially of silver bromide or silver bromoiodide with a silver iodide content within the range of 0 to 10 mole %, and b) a plurality of shells consisting essentially of silver bromide or silver bromoiodide, wherein a pure silver iodide phase representing from 0.1 to 5 mole % of the total silver halide grain content is interposed between two adjacent shells, and wherein at least one of said adjacent shells has a silver iodide content higher than 5 mole %.

Light-sensitive silver halide color photographic materials generally comprise a plurality of uniform layers of light-sensitive silver halide emulsions having different color sensitivities with dry thicknesses of a few microns coated on a support of cellulose triacetate or polyethyleneterephthalate. In such light-sensitive silver halide emulsions, there exist a large number of silver halide grains having grain sizes corresponding approximately to the wavelengths of visible rays and various crystal habits dispersed within a hydrophilic colloid such as gelatin having a refractive index smaller than that of silver halide. When visible light rays hit in the vertical direction the surface of such a light-sensitive silver halide emulsion layer, such rays are known to be scattered by the silver halide grains within the layer. This is said to be a phenomenon caused by the aforesaid grain sizes comparable to the wavelengths of visible rays and the difference in refractive index between grains and the binder. The extent of scattering may vary depending on the number of grains per unit volume, grains sizes, grain size distribution and the difference in refractive index between the silver halide grains and the binder. Thus, the visible light rays entering the light-sensitive silver halide emulsion layer, even when entering vertically the silver halide emulsion, is subject to scattering within the light-sensitive silver halide emulsion layer. Such a scattering causes the so called vagueness in the resulting image and consequently lowers its sharpness.

There have been proposed various methods to reduce the worsening of the image sharpness by light scattering as mentioned above.

One method of improving sharpness, disclosed at U.S. Pat. No. 4,312,941 and at U.S. Pat. No 4,391,884, involves the incorporation of a filter dye in a film layer between the exposing light source and a layer comprising a conventional grain light sensitive silver halide emulsion. The filter dye is made non diffusible either by means of a ballast group or by means of a mordanting material incorporated at a specific position in the film structure. Use of this spatial arrangement of absorber dye and emulsion reduces surface halation effects.

U.S. Pat. No. 4,439,520 discloses a radiation-sensitive high aspect ratio tabular grain silver halide emulsion comprised of a dispersing medium and silver halide grains, wherein at least 50 percent of the total projected area of the silver halide grains is provided by chemically and spectrally sensitized tubular silver halide grains having a thickness of less than 0.3 micrometer, a diameter of at least 0.6 micrometer, and an average aspect ratio of greater than 8:1.

U.S. Pat. No. 4,521,507 discloses a multi-layer light-sensitive silver halide color photographic material having a plurality of silver halide emulsion layers having different sensitivities to the different spectral regions of the visible light coated on a support, wherein at least 80% of the total number of silver halide grains in at least one said silver halide emulsion layers is represented by silver halide grains having grain sizes greater than 0.8 micrometer and grain size smaller than 0.65 micrometer.

These high aspect ratio silver halide emulsions, herein known as tabular grain emulsions, differ from conventional grain emulsions in many characteristics. One main characteristic is the relationship between the thickness and the equivalent circular diameter of the emulsion grains. Conventional emulsion grains tend to be isotropic in shape and, when incorporated in a layer structured film, tend to be randomly oriented within each layer. Tabular emulsion grains, tend to be anisotropic in shape and, when incorporated in a layer structured film, tend to align such that their major axis parallels the plane of the film base. This degree of anisotropicity is know as the emulsion aspect ratio (AR), typically defined as the ratio of the average grain equivalent circular diameter and the average grain thickness. The ability to control emulsion grain thickness and alignment within a film structure can allow the realization of otherwise unattainable degrees of photographic material performance.

"Research Disclosure", #25330, May, 1985, discloses methodologies related to the definition of particular arrangements of tabular grain emulsions having particular tabular grain thicknesses within a certain layer of a film structure so as to enable the attainment of specifically desired properties, such as speed or sharpness in underlying or overlying emulsion layers. No mention is made of the relationship between tabular grain thickness and the speed or sharpness of the emulsion layer comprising such grains.

U.S. Pat. No. 4,740,454 discloses a silver halide photographic material comprising a support having coated thereon at least one light-sensitive silver halide emulsion layer containing tabular silver halide grains which have an aspect ratio not less than 5:1 and which account for at least 50% of the total projected area of the silver halide grains present in the silver halide emulsion layer, the silver. halide photographic material further containing at least one 1,3,4-thiadiazole derivative.

U.S. Pat. No. 5,275,929 discloses a photographic material comprising a support bearing a photographic layer comprising a sensitized tabular grain silver halide emulsion of aspect ratio greater than 10:1 and of specific thickness to minimize the spectral reflectance in the region of the spectrum where the emulsion has its maximum sensitivity.

These methods have not been proved to be wholly satisfactory.

SUMMARY OF THE INVENTION

The present invention relates to a light-sensitive emulsion comprising silver bromoiodide grains of a core shell structure comprising: a) an inner core consisting essentially of silver bromide or silver bromoiodide and having a silver iodide content within the range of 0 to 10 mole %, and b) a plurality of shells consisting essentially of silver bromide or silver bromoiodide, wherein said silver bromoiodide grains exhibit an average grain size lower than 0.60 micrometer, an average grain thickness lower than 0.15 micrometer, and an average aspect ratio lower than 5:1.

DETAILED DESCRIPTION OF THE INVENTION

The light-sensitive emulsion of the present invention comprises silver bromoiodide grains having an inner core and a plurality of shells. The inner core consists essentially of silver bromide or silver bromoiodide. The plurality of shells consists essentially of silver bromide or silver bromoiodide having different compositions.

The silver iodide content of the inner core is in the range of from 0 to 20 mol % relative to the total silver halide content of the inner core, preferably from 0 to 10 mol %, and more preferably from 0 to 5 mol %.

The silver iodide content of each shell is in the range of from 0 to 40 mol %, preferably from 0 to 20 mol % relative to the total silver halide content of the shell. The plurality of shells comprises at least two shells having different silver halide composition.

The minimal core-shell structure of the silver halide grains consists in an inner core and two shells surrounding the inner core. The number of shells surrounding the inner core preferably ranges from two to four. Accordingly, the core-shell structure of the silver halide grains consists in an inner core, an innermost shell adjacent the inner core, an outermost shell, and, optionally, one or more intermediate shells interposed between the innermost shell and the outermost shell. Preferably, the innermost shell adjacent to the inner core has a silver bromoiodide composition, with a silver iodide content of from 2 to 20 mol %, most preferably from 3 to 10 mol %, relative to the total silver halide content of the shell, and the outermost shell has a silver bromide composition. The intermediate shells can have a silver bromide or silver bromoiodide composition, with a silver iodide content ranging from 0 to 40 mol %, preferably from 0 to 20 mol % relative to the total silver halide content of the shell.

The silver content of the core and the plurality of shells relative to the total silver content of the grain can have different values depending on the number of shells representing the plurality of shells. Preferably, the silver content of the inner core represents from 10 to 50 mol %, more preferably from 10 to 30 mol % relative to the total silver content of the grain. Preferably, the silver content of the plurality of shells represents from 50 to 90 mol %, more preferably from 70 to 90 mol % relative to the total silver content of the grain. Each shell can have a silver content ranging from 5 to 40 mol %, preferably from 10 to 25 mol % relative to the total silver content of the grain.

The average iodide content of the silver halide grains ranges from 1 to 15 mol %, preferably from 2 to 10 mol %, and more preferably from 3 to 6 mol % relative to the total halide content of the emulsion grains.

Accordingly, the core shell emulsion according to the present invention can be represented by the following, not limitative examples:

| | |
|---|---|
| Core: AgBr | Shell: AgBr |
| Shell: $AgBr_{85\%}I_{15\%}$ | Core: AgBr |
| Shell: $AgBr_{95\%}I_{5\%}$ | Shell: $AgBr_{85\%}I_{15\%}$ |
| Shell: $AgBr_{85\%}I_{15\%}$ | Core: AgBr |
| Shell: $AgBr_{95\%}I_{5\%}$ | Shell: $AgBr_{95\%}I_{5\%}$ |
| Shell: AgBr | Shell: $AgBr_{80\%}I_{20\%}$ |
| Core: AgBr | Shell: AgBr |
| Shell: $AgBr_{95\%}I_{5\%}$ | Core: AgBr |
| Shell: AgBr | Shell: $AgBr_{95\%}I_{5\%}$ |
| Shell: $AgBr_{85\%}I_{10\%}$ | Shell: AgBr |
| Core: AgBr | Shell: $AgBr_{85\%}I_{15\%}$ |
| Shell: $AgBr_{95\%}I_{4\%}$ | Shell: AgBr |

As described in U.S. Pat. No. 6,258,522 a pure silver iodide phase may be interposed between two adjacent shells The pure silver iodide phase has a silver content ranging from 0.1 to 5 mol %, preferably from 1 to 3 mol % relative to the total silver content of the grain. In such a case, at least one of the two shells adjacent the above mentioned pure silver iodide phase (that is, the two shells in contact with the pure silver iodide phase) should preferably have a silver iodide content higher than 5 mole %, preferably higher than 10 mole % relative to the total silver halide content of the shell.

The wording "consisting essentially of silver bromide or silver bromoiodide" employed hereinabove in describing the core-shell emulsion means that the amount of halides different than iodide and bromide in such a core-shell emulsion is less than 3 mole %.

The light-sensitive emulsion is preferably monodispersed, and the coefficient of variation (COV) of the distribution is preferably lower than 0.30, more preferably lower than 0.20, and most preferably lower than 0.15. The term "COV" is a value representing the standard deviation of grain diameter divided by the average grain diameter. Grain diameter is the diameter of a circle having an area equal to the projected area of the grain and is also referred to as "equivalent circular diameter" or "ECD".

The tabular silver bromoiodid grains contained in the emulsion of the present invention have an average diameter to thickness ratio (aspect ratio) lower than 5:1, preferably lower than 4:1, an average diameter lower than 0.60 micrometer, preferably lower than 0.50 micrometer, and more preferably lower than 0.40 micrometer, and an average thickness lower than 0.15 micrometer, preferably less than 0.13 micrometer and more preferably less than 0.1 1 micrometer.

The tabular grain characteristics described above can be readily ascertained by procedures well known to those skilled in the art. The term "diameter" is defined as the diameter of a circle having an area equal to the projected area of the grain. The term "thickness" means the distance between two substantially parallel main planes constituting the tabular grains. From the measure of diameter and thickness of each grain the aspect ratio of each grain can be calculated. The aspect ratios of all tabular grains can be averaged to obtain their average aspect ratio. By this definition the average aspect ratio is the average of individual tabular grain aspect ratios. In practice, it is simpler to obtain an average diameter and an average thickness of the tabular grains and to calculate the average aspect ratio as the ratio of these two averages. Whatever the used method may be, the average aspect ratios obtained do not greatly differ.

Photosensitive silver halide emulsions can be formed by precipitating silver halide grains in an aqueous dispersing medium comprising a binder, gelatin preferably being used as a binder.

The silver halide grains may be precipitated by a variety of conventional techniques. The silver halide emulsion can be prepared using a single-jet method, a double-jet method, or a combination of these methods or can be matured using, for instance, an ammonia method, a neutralization method, an acid method, or can be performed an accelerated or constant flow rate precipitation, interrupted precipitation, ultrafiltration during precipitation, etc. Several references can be found in Trivelli and Smith, The Photographic Journal, Vol. LXXIX, May 1939, pp. 330–338, T. H. James, The Theory of The Photographic Process, 4th Edition, Chapter 3, U.S. Pat. Nos. 2,222,264, 3,650,757, 3,917,485, 3,790,387, 3,716,276, 3,979,213, Research Disclosure, December 1989, Item 308119 "Photographic Silver Halide Emulsions, Preparations, Addenda, Processing and Systems", and Research Disclosure, September 1976, Item 14987.

One common technique is the process commonly referred to as the double-jet precipitation process by which a silver salt solution in water and a halide salt solution in water are concurrently added into a reaction vessel containing the dispersing medium.

In the double jet method the shape and size of the silver halide grains can be controlled by the kind and concentration of the solvent existing in the gelatin solution and by the addition speed. Double-jet precipitation processes are described, for example, in GB 1,027,146, GB 1,302,405, U.S. Pat. Nos. 3,801,326, 4,046,376, 3,790,386, 3,897,935, 4,147,551, and 4,171,224.

Precipitation of silver halide grains usually occurs in two distinct stages. In a first stage, nucleation, formation of fine silver halide grains occurs. This is followed by a second stage, growth, in which further silver halide precipitates onto the initially formed silver halide grains, resulting in a growth of these silver halide grains. Double-jet precipitation processes are typically undertaken under conditions of rapid stirring of reactants. The water dispersion volume within the reaction vessel continuously increases during silver halide precipitation and soluble salts, normally potassium and/or sodium nitrates, are formed in addition to the silver halide grains. In order to avoid soluble salts in the emulsion layers of a photographic material from crystallizing out after coating and other photographic or mechanical disadvantages (stickiness, brittleness, etc.), such soluble salts have to be removed.

In preparing the silver halide emulsions of the present invention, a wide variety of hydrophilic dispersing agents can be employed. Any hydrophilic polymer conventionally used in photography can be advantageously employed including gelatin, gelatin derivatives such as acylated gelatin, albumin, gum arabic, agar agar, cellulose derivatives, such as hydroxyethylcellulose or carboxymethylcellulose, synthetic resins, such as polyvinyl alcohol, polyvinylpyrrolidone or polyacrylamide. Other hydrophilic materials useful known in the art are described, for example, in Research Disclosure, Vol. 308, Item 308119, Section IX.

The core-shell silver bromoiodide emulsion of the present invention can be prepared according to the following manufacturing method. For sake of clarity, the following description was limited to the preparation of a core-shell emulsion comprising two shells, but the present invention is not intended to be limited to such a constructions.

1. An aqueous solution prepared by dissolving gelatin, a bromide salt, and, optionally a iodide salt in distilled water was provided in a reaction vessel. The solution was stirred by a dispersator and kept at about 30° to 60° C.

2. An aqueous silver salt solution and an aqueous bromide salt solution were added to the resulting solution by double jet under stirring, by keeping constant the temperature between 30° to 60° C. The double jet addition of silver and bromide salts can be repeated one or more times, by varying the addition conditions (pAg, rate of addition, etc.) until to reach the precipitation of the total silver requested for the formation of the core. The rate of addition could be kept constant in the range of from 5 to 60 ml/minute or could vary from an initial flow of from 5 to 30 ml/minute, to a final flow of from 20 to 60 ml/minute. The accelerated double jet profile could be linear, quadratic, or step-by-step, by employing silver and bromide salt solutions with different concentrations. Optionally, an iodide salt aqueous solution could be added during the growth.
3. An aqueous silver salt solution, an aqueous bromide salt solution, and, optionally, an aqueous iodide salt solution were added under stirring to the resulting dispersion. The bromide and iodide salts could also be added from a single solution. The rate of addition could be kept constant in the range of from 5 to 60 ml/minute or could vary from an initial flow of from 5 to 30 ml/minute, to a final flow of from 20 to 60 ml/minute. The accelerated double jet profile could be linear, quadratic, or step-by-step, by employing silver and bromide salt solutions with different concentrations.
4. An aqueous silver salt solution, an aqueous bromide salt solution, and, optionally, an aqueous iodide salt solution were added under stirring. The bromide and iodide salts could also be added from a single solution. The rate of addition could be kept constant in the range of from 5 to 60 ml/minute or could vary from an initial flow of from 5 to 30 ml/minute, to a final flow of from 20 to 60 ml/minute. The accelerated double jet profile could be linear, quadratic, or step-by-step, by employing silver and bromide salt solutions with different concentrations.

As mentioned above, an aqueous iodide salt solution may be added at constant rate in a period of from one to five minutes between step 3 and 4. In such a case, such an addition is preceded by the addition of ammonia solution and followed by neutralization.

The silver halide emulsion of the present invention can be chemically sensitized using sensitizing agents known In the art. Sulfur containing compounds, gold and noble metal compounds, and polyoxylakylene compounds are particularly suitable. In particular, the silver halide emulsions may be chemically sensitized with a sulfur sensitizer, such as sodium thiosulfate, allylthiocyanate, allylthiourea, thiosulfinic acid and its sodium salt, sulfonic acid and its sodium salt, allylthiocarbamide, thiourea, and cystine; an active or inert selenium sensitizer; a reducing sensitizer such as a stannous salt, and a polyamine; a noble metal sensitizer, such as a gold sensitizer, more specifically potassium aurithiocyanate, and potassium chloroaurate; or a sensitizer of a water soluble salt such as for instance of ruthenium, rhodium, iridium and the like, more specifically, ammonium chlorapalladate, potassium chloroplatinate and sodium chloropalladite, each being employed either alone or in a suitable combination. Other useful examples of chemical sensitizers are described, for example, in Research Disclosure 17643, Section III, 1978 and in Research Disclosure 308119, Section III, 1989.

The silver halide emulsion of the present invention can be spectrally sensitized with dyes from a variety of classes, including the polymethyne dye class, which includes the cyanines, merocyanines, complex cyanines and merocyanines, oxonols, hemioxonols, styryls, merostyryls, and streptocyanine.

The cyanine spectral sensitizing dyes include, joined by a methine linkage, two basic heterocyclic nuclei, for example those derived from quinoline, pyrimidine, isoquinoline, indole, benzindole, oxazole, thiazole, selenazole, imidazole, benzoxazole, benzothiazole, benzoselenazole, benzoimidazole, naphthoxazole, naphthothiazole, naphthoselenazole, tellurazole, oxatellurazole.

The merocyanine spectral sensitizing dyes include, joined by a methine linkage, a basic hetercyclic nucleus of the cyanine-dye type and an acidic nucleus, which can be derived, for example, from barbituric acid, 2-thiobarbituric acid, rhodanine, hydantoin, 2-thiohydantoin, 2-pirazolin-5-one, 2-isoxazolin-5-one, indan-1,3-dione, cyclohexane1,3-dione, 1,3-dioxane-4,6-dione, pyrazolin-3,5-dione, pentane-2,4-dione, alkylsulfonylacetonitrile, malononitrile, isoquinolin-4-one, and chromane-2,4-dione.

One or more spectral sensitizing dyes may be used. Dyes with sensitizing maxima at wavelengths throughout the visible and infrared spectrum and with a great variety of spectral sensitivity curve shapes are known. The choice and relative proportion of dyes depend on the region of the spectrum to which sensitivity is desired and on the curve shape of the spectral sensitivity desired.

Examples of sensitizing dyes can be found in Venkataraman, *The chemistry of Synthetic Dyes,* Academic Press, New York, 1971, Chapter V, James, *The Theory of the Photographic Process,* 4th Ed., Macmillan, 1977, Chapter 8, F. M. Hamer, *Cyanine Dyes and Related Compounds,* John Wiley and Sons, 1964.

Silver halide multilayer color photographic elements usually comprise, coated on a support, a red sensitized silver halide emulsion layer associated with cyan dye-forming color couplers, a green sensitized silver halide emulsion layer associated with magenta dye-forming color couplers and a blue sensitized silver halide emulsion layer associated with yellow dye-forming color couplers. The silver halide emulsion of the present invention can be preferably used in the blue sensitized silver halide emulsion layer. Each silver halide emulsion layer can be comprised of a single emulsion layer or of a plurality of emulsion sub-layers sensitive to a given region of visible spectrum. When multilayer materials contain multiple blue, green or red sub-layers, there can be in any case relatively faster and relatively slower sub-layers. The silver halide emulsion of the present invention can be preferably used in the relatively slower sub-layers, more preferably in the slowest sub-layer. These elements additionally comprise other non-light sensitive layers, such as intermediate layers, filter layers, antihalation layers and protective layers, thus forming a multilayer structure. These color photographic elements, after imagewise exposure to visible radiations, are processed in a chromogenic developer to yield a visible color image. The layers can be coated in any convenetional order, but in a preferred layer arrangement the red-sensitive layers are coated nearest the support and are overcoated by the green-sensitive layers, then by a yellow filter layer and finally by the blue-sensitive layers.

The most useful cyan-forming couplers are conventional phenol compounds and α-naphthol compounds. Examples of cyan couplers can be selected from those described in U.S. Pat. Nos. 2,369,929; 2,474,293; 3,591,383; 2,895,826; 3,458,315; 3,311,476; 3,419,390; 3,476,563 and 3,253,924; and in GB patent 1,201,110.

The most useful magenta-forming couplers are conventional pyrazolone type compounds, indazolone type compounds, cyanoacetyl compounds, and pyrazoletriazole type compounds. Particularly preferred couplers are pyrazolone type compounds. Magenta-forming couplers are described for example in U.S. Pat. Nos. 2,600,788, 2,983,608, 3,062,653, 3,127,269, 3,311,476, 3,419,391, 3,519,429, 3,558,319, 3,582,322, 3,615,506, 3,834,908 and 3,891,445, in DE patent 1,810,464, in DE patent applications 2,408,665, 2,417,945, 2,418,959 and 2,424,467 and in JP patent applications 20,826/76, 58,922/77, 129,538/74, 74,027/74, 159,336/75, 42,121/77, 74,028/74, 60,233/75, 26,541/76 and 55,122/78.

The most useful yellow-forming couplers are conventional open-chain ketomethylene type compounds. Particular examples of such couplers are benzoyl-acetanilide type and pivaloyl acetanilide type compounds. Yellow-forming couplers that can be used are specifically described in U.S. Pat. Nos. 2,875,057, 3,235,924, 3,265,506, 3,278,658, 3,369,859, 3,408,194, 3,415,652 3,528,322, 3,551,151, 3,682,322, 3,725,072 and 3,891,445, in DE patents 2,219,917, 2,261,361 and 2,414,006, in GB patent 1,425,020, in JP patent 10,783/76 and in JP patent applications 26,133/72, 73,147/73, 102,636/76, 6,341/75, 123,342/75, 130,442/75, 1,827/76, 87,650/75, 82,424/77 and 115,219/77.

Colored couplers, couplers providing diffusible colored dyes, DIR couplers, DAR couplers, FAR couplers and BAR couplers can also be used in the preparation light-sensitive silver halide photographic elements as described in U.S. Pat. No. 6,258,522.

In order to introduce the couplers into the silver halide emulsion layer, some conventional methods known to the skilled in the art can be employed, such as, for example, by the dispersion technique, by the so-called "loaded-latex technique" or by the Fisher process, as described in U.S. Pat. No. 6,258,522.

The present invention will be illustrated with reference to the following examples, but it should be understood that these examples do not limit the present invention.

EXAMPLE

Preparation of Emulsion 1 (Invention)

17518

A core-shell silver bromoiodide grain emulsion was prepared according to the following procedure.

An aqueous solution prepared by dissolving 29.50 g of deionized gelatin, 11.80 g of ammonium bromide, and 1.30 g of sodium thiocyanate in 3290 g of distilled water was stirred by a dispersator at 4000 rpm and T=25° C.

A double jet addition of 100.00 ml of a silver nitrate solution (2.50M) and 111.11 ml of a ammonium bromide solution (2.25M) was performed at constant flow rate in one minute. The emulsion was kept under stirring for 120 seconds.

After that, 22,00 ml of a silver nitrate solution (2.50M) were added at constant flow rate in a period of 2 minutes raising the pBr value to 1.785.

The temperature was then increased from 25° C. to 70° C. in a period of 22 minutes. A dump addition of an aqueous solution containing 32.10 g of deionized gelatin in 400.00 g of distilled water was performed during this period when the temperature reached 50° C. The emulsion was ripened at 70° C. over a period of 30 minutes and then the temperature was decreased from 70° C. to 45° C. over a period of 10 minutes.

After that, 10.00 ml of a ammonium bromide solution (2.25M) were added at constant flow rate in a period of 1 minute reducing the pBr value to 1.697.

Then, 403.58 ml of a silver nitrate solution (2.50M) were added with a linear accelerated ramp (from 28.25 ml/min to 67.84 ml/min) and at the same time a ammonium bromide solution (2.25M) was added to maintain the pBr value at 1.697. The double-jet addition was completed in twelve minutes.

The resulting dispersion was kept under stirring at 4,000 rpm for 120 seconds and then the stirring rate was increased to 5,000 rpm before the starting of the next double jet addition.

During the next thirty three minutes, a silver nitrate solution (2.50M) and an ammonium bromide solution (2.25M) were added at a constant flow rate of 22.85 ml/min together with a potassium iodide solution (0.25M) added at a constant flow rate of 18.28 ml/min. Then, the emulsion was kept under stirring at 2,000 for 120 seconds.

During the next fifty minutes, a silver nitrate solution (2.50M) was added at a constant flow rate of 20.00 ml/min by maintaining the pBr value at 2.769 with a potassium bromide solution (2.25M). During the last ten minutes, a potassium iodide solution (0.25M) was added at a constant flow rate of 7.6 ml/min.

The resulting emulsion exhibited an average diameter of 0.49 micrometer, an average thickness of 0.120 micrometer, and an average aspect ratio of 4.1:1. The core-shell structure is summarized in Table 1. The total average iodide content was 2.6% mol.

Preparation of Emulsion 2 (Invention)

17546

A core-shell silver bromoiodide emulsion was prepared according to the following procedure.

An aqueous solution prepared by dissolving 9.50 g of deionized gelatin, 11.80 g of ammonium bromide, and 1.30 g of sodium thiocyanate in 3290 g of distilled water was stirred by a dispersator at 4000 rpm and T=25° C.

A double jet addition of 100.00 ml of a silver nitrate solution (2.50M) and 111.11 ml of a ammonium bromide solution (2.25M) was performed at constant flow rate in one minute. The emulsion was kept under stirring for 120 seconds.

After that, 22.00 ml of a silver nitrate solution (2.50M) were added at constant flow rate in a period of 2 minutes raising the pBr value to 1.785.

The temperature was then increased from 25° C. to 70° C. in a period of 22 minutes. A dump addition of an aqueous solution containing 32.10 g of deionized gelatin in 400.00 g of distilled water was performed during this period when the temperature reached 50° C. The emulsion was ripened at 70° C. over a period of 30 minutes and then the temperature was decreased from 70° C. to 45° C. over a period of 10 minutes.

After that, 10 ml of a ammonium bromide solution (2.25M) were added at constant flow rate in a period of 1 minute.reducing the pBr value to 1.697.

Then, 403.58 ml of a silver nitrate solution (2.50M) were added with a linear accelerated ramp (from 28.25 ml/min to 67.84 ml/min) and at the same time a ammonium bromide solution (2.25M) was added to maintain the pBr value at 1.697. The double-jet addition was completed In eight minutes and twenty four seconds.

The resulting dispersion was kept under stirring at 4,000 rpm for 120 seconds and then the stirring rate was increased to 5,000 rpm before the starting of the next double jet addition.

During the next twenty one minutes, a silver nitrate solution (2.50M) and an ammonium bromide solution (2.25M) were added at constant flow rate (22.85 ml/min) together with a potassium iodide solution (0.25M) added at constant flow rate (18.28 ml/min). Then, the emulsion was kept under stirring at 2,000 for 120 seconds.

During the next thirty five minutes, a silver nitrate solution (2.50M) was added at constant flow rate (20 ml/min) by maintaining the pBr value at 2.769 with a potassium bromide solution (2.25M). During the last seven minutes, a potassium iodide solution (0.25M) was added at constant flow rate (7.6 ml/min).

The resulting emulsion exhibited an average diameter of 0.41 micrometer, an average thickness of 0.105 micrometer, and an average aspect ratio of 3.9:1. The core-shell structure is summarized in Table 1. The total average iodid content was 2.6% mol.

Preparation of Emulsions 3–5 (Comparison)

The procedure described in example 1 of U.S. Pat No. 6,258,522 was applied to obtain a silver bromoiodide emulsion 3 exhibiting an average diameter of 0.80 micrometer, an average thickness of 0.260 micrometer, and an average aspect ratio of 3.1:1, a silver halide emulsion 4 exhibiting an average diameter of 0.65 micrometer, an average thickness of 0.260 micrometer, and an average aspect ratio of 2.5:1, and a silver halide emulsion 5 exhibiting an average diameter of 0.85 micrometer, an average thickness of 0.170 micrometer, and an average aspect ratio of 5.0:1. The core-shell structure is summarized in Table 1. The total average iodide content was 5.0% mol.

Preparation of Emulsion 6 (Comparison)

Emulsion 6 was prepared according to the teaching of U.S. Pat. No. 6,242,168 to obtain a cube-octahedral core-shell silver bromo-iodide emulsion having an average diameter of 0.37 micrometer, an average thickness of 0.370 micrometer, and an average aspect ratio of 1,0:1. The coreshell structure is summarized in Table 1. The total average iodide content was 3.0% mole.

The following table 1 summarizes the core-shell structure characteristics of the emulsions 1 to 6.

TABLE 1

| | Emulsion 1 and 2 (17546 17518) | | Emulsion 3 and 4 (WM70-60)* | | Emulsion 5 (17435)** | | Emulsion 6 (WL33) | |
|---|---|---|---|---|---|---|---|---|
| | % Ag | AgI % | % Ag | AgI % | % Ag | AgI % | % Ag | AgI % |
| Core | 23.10 | 0.00 | 36.20 | 0.00 | 30.20 | 0.00 | 10.00 | 0.00 |
| I Shell | 33.10 | 8.00 | 17.50 | 2.50 | 10.20 | 5.10 | 65.00 | 4.70 |
| II Shell | 35.80 | 0.00 | 4.50 | 0.00 | 17.30 | 0.00 | 25.00 | 0.00 |
| III Shell | 8.20 | 3.80 | 20.90 | 14.00 | 19.20 | 16.20 | — | — |
| IV Shell | — | — | 23.10 | 0.00 | 23.10 | 0.00 | — | — |

*Emulsions 3 and 4 have a pure iodide phase representing 1.60% of the total Ag between shells II and III
**Emulsion 5 has a pure iodide phase representing 2.00% of the total Ag between shells II and III All the emulsions were chemically sensitized with gold and sulfur using p-toluenethiosulfonic acid, p-toluenesulfinic acid and gold tetrachloroaurate complexed with potassium thiocyanate.

The emulsions 1 to 6 were coated on a cellulose triacetate transparent support base at a silver coverage of 1.0 grams per square meter to obtain sample films 1 to 6, respectively.

The samples 1 to 6 were tested according to the following analytical methods.

Angle scattering: The sample was placed in a sample holder and immersed in an oil having a refractive index (1.52) matched to minimize Fresnel reflections. Then, the sample was exposed to a collimated laser light (greeen or red) and the light scattered by the sample was sensed on a emispherical surface at a distance of 35 cm from the sample. The relative light intensity at an angle of 60° from the sample central axis was recorded as a measuremet of "angle scattering" by means of a goniophotometer. This method is also described in GB 2,110,830.

Reflectance: Reflectance maxima and minima were measured on the coated samples through a Lambda 19 Perkin Elmer Spectrophotometer equipped with an integrating sphere allowing total reflectance measurement on flat samples. The incident light was at 8° angle of incidence. The method is also described in Research Disclosure No. 25330, May 1985.

Total scattering: Total light scattering was measured through a Lambda 19 Perkin Elmer Spectrophotometer as an optical density TLS=SP−TDD, where SP is the optical density measured with the sample placed at 40 cm from the light sensor (Specular Density) and TDD is the optical density measured when the sample is contacted to the light sensor (Total Diffuse Density). The difference (TLS) is a measurement of the light scattered by the sample. The method is also described in Research Disclosure No. 13452 June 1975.

TABLE 2

| Sample | Reflectance | | | | Angle scattering | | Total scattering | |
|---|---|---|---|---|---|---|---|---|
| Sample | Min1 | Max1 | Min2 | Max2 | Green | Red | Green | Red |
| 1 | 552 | 389 | — | — | 0.17 | 0.35 | 0.61 | 0.42 |
| 2 | 491 | 348 | — | — | 0.20 | 0.39 | 0.46 | 0.39 |
| 3 | — | 769 | 593 | 478 | 0.18 | 0.40 | 0.76 | 0.67 |
| 4 | — | 769 | 593 | 478 | 0.23 | 0.48 | 0.82 | 0.69 |
| 5 | — | 525 | 409 | 340 | 0.20 | 0.45 | 0.77 | 0.65 |
| 6 | — | — | — | — | 0.25 | 0.50 | 1.01 | 0.77 |

The silver halide emulsions 1 and 2 of the invention showed a substantial reduction of both angle scattering and total scattering and no reflection maxima in the visible part of the spectrum, so allowing to obtain a better definition and sharpness.

A multilayer color photographic element (color film 1, Invention) was prepared using the composition and procedure described in U.S. Pat. No. 6,242,168 by replacing the silver halide emulsion of the first yellow layer with emulsion 1. Another multilayer color photographic element (color film 2, Comparison) was prepared in the same way by replacing the silver halide emulsion of the first yellow layer with emulsion 6.

The resolving power of the color films 1 and 2 was measured according to the following analytical method. Each color film was exposed to white light through a target having low contrast. Then, the color films were developed in standard developing chemistry C41 and the resulting image was evaluated with a Leitz Microscope equipped with a 5× objective and 10× ocular. The whole method was run according to ISO 6328 :1997. Color film 1 of the invention showed a maximum value of 107 l/mm versus a maximum value of 98 l/mm for comparison color film 2. Sensitometric results were not negatively affected as showed by the following table 3.

TABLE 3

| | D-min | D-max | Speed 0.2 | Speed 1.0 | Toe Contrast | Shoulder Contrast |
|---|---|---|---|---|---|---|
| Film 1 (Invention) | 0.96 | 3.35 | 2.27 | 1.17 | 0.66 | 0.78 |
| Film 2 (Comparison) | 0.96 | 3.35 | 2.27 | 1.15 | 0.63 | 0.74 |

What is claimed is:

1. A light-sensitive emulsion comprising silver bromoiodide grains of a core shell structure comprising: a) an inner core consisting essentially of silver bromide or silver bromoiodide and having a silver iodide content within the range of 0 to 10 mole %, and b) a plurality of shells consisting essentially of silver bromide or silver bromoiodide, wherein said silver bromoiodide grains exhibit an average grain size lower than 0.60 micrometer, an average grain thickness lower than 0.15 micrometer, and an average aspect ratio lower than 5:1.

2. The light-sensitive emulsion according to claim 1, wherein said inner core consists essentially of silver bromide.

3. The light-sensitive emulsion according to claim 1, wherein said silver bromoiodide grains have an average iodide content ranging from 1 to 10 mol %, relative to the total halide content of the grains.

4. The light-sensitive emulsion according to claim 1, wherein the silver content of said inner core ranges from 10 to 50 mol % relative to the total silver content of the grains and the silver content of said plurality of shells ranges from 50 to 90 mol % relative to the total silver content of the grains.

5. A light-sensitive silver halide photographic material comprising a support and at least one red sensitized silver halide emulsion layer associated with cyan dye-forming color couplers, at least one green sensitized silver halide emulsion layer associated with magenta dye-forming color couplers and at least one blue sensitized silver halide emulsion layer associated with yellow dye-forming color couplers, wherein at least one of said silver halide emulsion layers comprises a core-shell emulsion comprising silver bromoiodide grains having: a) an inner core consisting essentially of silver bromide or silver bromoiodide and having a silver iodide content within the range of 0 to 10 mole %, and b) a plurality of shells consisting essentially of silver bromide or silver bromoiodide, wherein said silver bromoiodide grains exhibit an average grain size lower than 0.60 micrometer, an average grain thickness lower than 0.15 micrometer, and an average aspect ratio lower than 5:1.

6. The silver halide photographic material according to claim 5, wherein said inner core consists essentially of silver bromide.

7. The silver halide photographic material according to claim 5, wherein said silver bromoiodide grains have an average iodide content ranging from 1 to 10 mol %, relative to the total halide content of the grains.

8. The silver halide photographic material according to claim 5, wherein the silver content of said inner core ranges from 10 to 50 mol % relative to the total silver content of the grains and the silver content of said plurality of shells ranges from 50 to 90 mol % relative to the total silver content of the grains.

9. The silver halide photographic material according to claim 5, wherein said core-shell emulsion is present in at least one of said blue sensitized silver halide emulsion layer associated with yellow dye-forming color couplers.

10. The silver halide photographic material according to claim 9, wherein said blue sensitized silver halide emulsion layer comprises at least two sub-layers of different sensitivities, and said core-shell emulsion is present in the layer of lowest sensitivity.

* * * * *